US009938101B2

(12) United States Patent
Watanabe et al.

(10) Patent No.: US 9,938,101 B2
(45) Date of Patent: Apr. 10, 2018

(54) SHEET TRANSPORT DEVICE AND IMAGE FORMING APPARATUS

(71) Applicant: FUJI XEROX CO., LTD., Tokyo (JP)

(72) Inventors: Kiyoshi Watanabe, Kanagawa (JP); Yuta Chino, Kanagawa (JP); Junji Hagihara, Kanagawa (JP); Toshitaka Tanaka, Kanagawa (JP); Tatsuya Yamashita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/818,448

(22) Filed: Aug. 5, 2015

(65) Prior Publication Data

US 2016/0280488 A1 Sep. 29, 2016

(30) Foreign Application Priority Data

Mar. 27, 2015 (JP) ..... 2015-067136

(51) Int. Cl.
*B65H 9/16* (2006.01)
*B65H 5/06* (2006.01)
(Continued)

(52) U.S. Cl.
CPC ..... *B65H 9/166* (2013.01); *B65H 5/062* (2013.01); *B65H 7/08* (2013.01); *B65H 7/10* (2013.01);
(Continued)

(58) Field of Classification Search
CPC ..... B65H 9/00; B65H 9/002; B65H 9/004; B65H 9/006; B65H 9/10; B65H 9/101;
(Continued)

(56) References Cited

U.S. PATENT DOCUMENTS 5,697,609 A * 12/1997 Williams ..... B65H 9/002 271/228
6,032,949 A * 3/2000 Ando ..... B65H 9/166 271/186
(Continued)

FOREIGN PATENT DOCUMENTS

JP 02028447 A * 1/1990 ..... B65H 9/04
JP 04039221 A * 2/1992 ..... B65H 3/06
(Continued)

*Primary Examiner* — Prasad V Gokhale
(74) *Attorney, Agent, or Firm* — Sughrue Mion, PLLC

(57) ABSTRACT

A sheet transport device includes a transport path along which a sheet is transported in one direction; a sheet butting portion provided at one side of the transport path; a sheet rotating section; and a sheet butting section. When a short sheet is transported along the transport path, the sheet rotating section rotates the short sheet such that a leading end is directed to the other side of the transport path, and when a long sheet is transported, the sheet rotating section rotates the long sheet such that an angle of inclination with respect to the one direction is reduced. The sheet butting section moves the short sheet rotated by the sheet rotating section toward the one side to make the side edge of the short sheet butt against the sheet butting portion, while allowing the long sheet to pass therethrough without moving the long sheet toward the one side.

2 Claims, 8 Drawing Sheets

(51) Int. Cl.
*B65H 9/00* (2006.01)
*B65H 7/08* (2006.01)
*B65H 7/10* (2006.01)

(52) U.S. Cl.
CPC ..... *B65H 9/002* (2013.01); *B65H 9/004* (2013.01); *B65H 9/006* (2013.01); *B65H 2404/144* (2013.01); *B65H 2511/11* (2013.01); *B65H 2511/212* (2013.01); *B65H 2511/242* (2013.01); *B65H 2511/414* (2013.01); *B65H 2513/53* (2013.01); *B65H 2515/112* (2013.01); *B65H 2701/1311* (2013.01); *B65H 2801/06* (2013.01)

(58) Field of Classification Search
CPC ..... B65H 9/103; B65H 9/106; B65H 9/16; B65H 9/166; B65H 2404/144; B65H 2404/1441; B65H 2404/1442
USPC ..... 271/234, 236, 239, 242, 243, 248, 251
See application file for complete search history.

(56) References Cited

U.S. PATENT DOCUMENTS

| | | | | |
|---|---|---|---|---|
| 9,280,118 | B2 * | 3/2016 | Endo | G03G 15/235 |
| 2007/0235920 | A1 * | 10/2007 | Kawashima | B65H 9/002 271/228 |
| 2012/0112406 | A1 * | 5/2012 | Matsumoto | B65H 5/023 271/234 |

FOREIGN PATENT DOCUMENTS

| | | | | |
|---|---|---|---|---|
| JP | 06166451 | A * | 6/1994 | B65H 9/16 |
| JP | 2002-060097 | A | 2/2002 | |

* cited by examiner

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2015-067136 filed Mar. 27, 2015.

BACKGROUND

Technical Field

The present invention relates to a sheet transport device and an image forming apparatus.

SUMMARY

According to an aspect of the invention, there is provided a sheet transport device including a transport path along which a sheet is transported in one direction; a sheet butting portion provided at one side of the transport path, against which sheet butting portion a side edge of the sheet on the transport path is butted; a sheet rotating section; and a sheet butting section disposed on a downstream side of the sheet rotating section. When a short sheet, which has a smaller sheet length than a predetermined sheet length, is transported along the transport path, the sheet rotating section rotates the short sheet such that a leading end thereof is directed to the other side of the transport path, and when a long sheet, which has a larger sheet length than the predetermined sheet length, is transported, the sheet rotating section rotates the long sheet such that an angle of inclination with respect to the one direction is reduced. The sheet butting section moves the short sheet rotated by the sheet rotating section toward the one side of the transport path to make the side edge of the short sheet butt against the sheet butting portion, while allowing the long sheet to pass therethrough without moving the long sheet toward the one side.

BRIEF DESCRIPTION OF THE DRAWINGS

Exemplary embodiment of the present invention will be described in detail based on the following figures, wherein.

DETAILED DESCRIPTION

Referring to the attached drawings, an exemplary embodiment of the present invention will be described in detail below.

Figure 1:
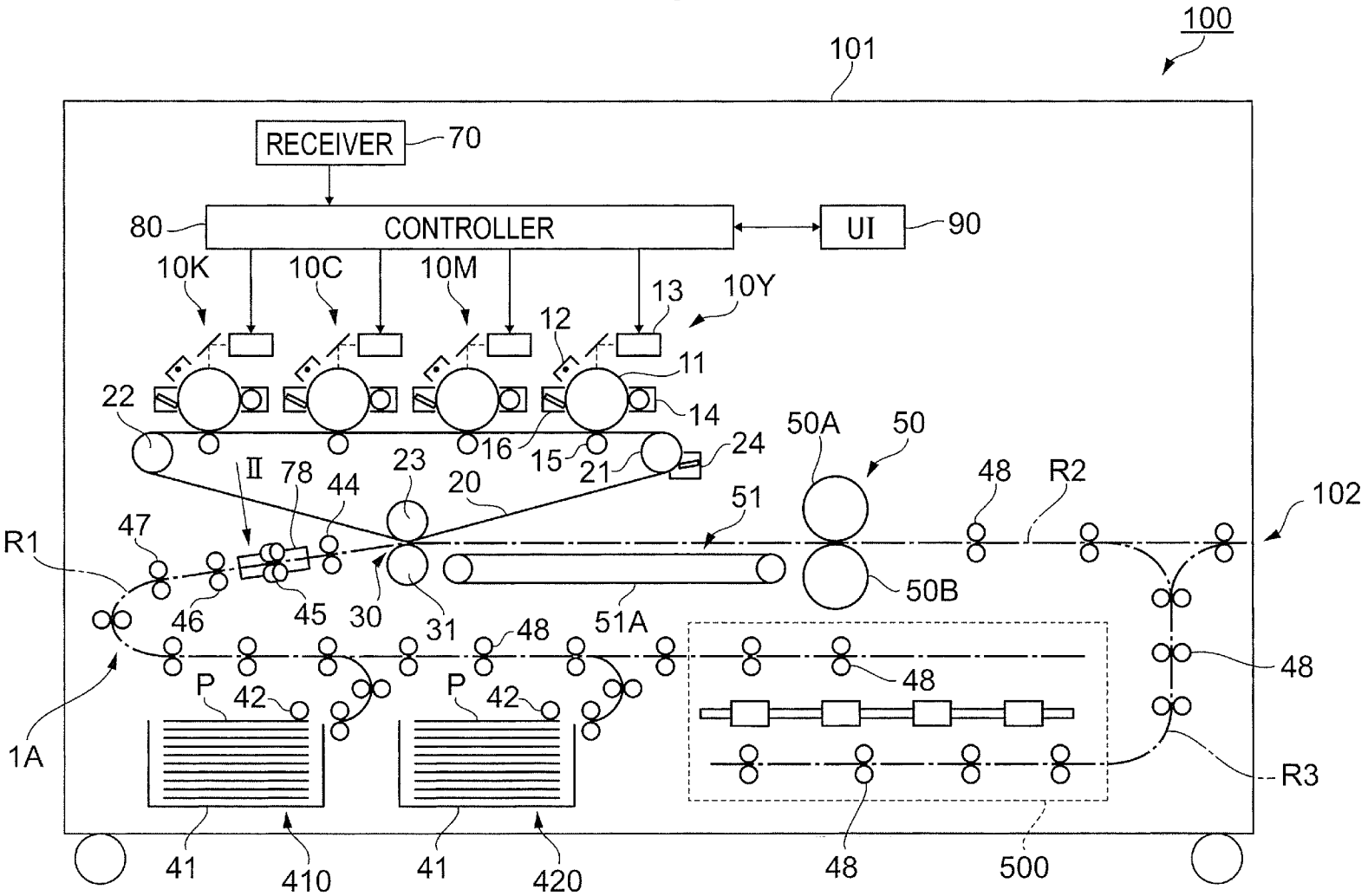
FIG. 1 shows an image forming apparatus, as viewed from the front side.

FIG. 1 shows an image forming apparatus 100 according to this exemplary embodiment, as viewed from the front side.

The image forming apparatus 100 includes image forming units 10 (10Y, 10M, 10C, and 10K) that form color-component toner images by an electrophotographic system.

The image forming apparatus 100 further includes a controller 80 that includes a central processing unit (CPU), a read only memory (ROM), etc. and that controls the operation of the devices and portions of the image forming apparatus 100.

The image forming apparatus 100 further includes a user interface portion (UI) 90. The UI 90 includes a display panel. The UI 90 outputs an instruction received from a user to the controller 80 and displays information from the controller 80 to the user.

The image forming apparatus 100 further includes an intermediate transfer belt 20 to which color-component toner images formed by the image forming units 10 are sequentially transferred (first transfer), and a second transfer device 30 that batch-transfers (second transfer) the toner images on the intermediate transfer belt 20 to a sheet P.

The image forming units 10, the intermediate transfer belt 20, and the second transfer device 30 may be regarded as an image forming section that forms an image on a sheet P.

The image forming apparatus 100 further includes a first sheet-transport path R1, along which a sheet P is transported toward the second transfer device 30; a second sheet-transport path R2, along which the sheet P is transported after passing through the second transfer device 30; and a third sheet-transport path R3 that is branched off the second sheet-transport path R2 and extends below the first sheet-transport path R1.

Furthermore, a reversing mechanism 500 that transports a sheet P from the third sheet-transport path R3 to the first sheet-transport path R1 and reverses the sheet P is provided. A housing 101 of the image forming apparatus 100 has an opening 102.

A sheet P transported along the second sheet-transport path R2 is discharged to the outside of the housing 101 through the opening 102 onto a sheet stacking portion (not shown). A processing device (not shown) may be provided adjacent to the housing 101 for further processing, such as perforating the sheet P discharged from the opening 102.

Furthermore, a first sheet feed device 410 and a second sheet feed device 420 that feed sheets P to the first sheet-transport path R1 are provided.

The first sheet feed device 410 and the second sheet feed device 420 have the same configuration. The first sheet feed device 410 and the second sheet feed device 420 each have a sheet accommodating portion 41 that accommodates sheets P and a pick-up roller 42 that picks up and transports a sheet P accommodated in the sheet accommodating portion 41.

On the upstream side of the second transfer device 30 is a first transport roller (registration roller) 44 that transports a sheet P on the first sheet-transport path R1 toward the second transfer device 30.

The first transport roller 44, serving as an example of a sheet transport member, temporarily stops a sheet P and then transports the sheet P toward the second transfer device 30 at predetermined timing.

Furthermore, on the upstream side of the first transport roller 44 is a butting portion 78, against which a side edge of a sheet P transported along the first sheet-transport path R1 is butted. The butting portion 78, serving as an example of a sheet butting portion, is provided at one side of the first sheet-transport path R1.

Furthermore, second transport rollers (alignment rollers) 45 are provided in front of the butting portion 78 in the drawings (i.e., in front of the butting portion 78 in the depth direction of the image forming apparatus 100). The second transport rollers 45, serving as an example of a sheet butting section, transport a sheet P downstream, while moving the sheet P toward the butting portion 78, making a side edge of the sheet P butt against the butting portion 78.

On the upstream side of the second transport rollers 45 is a third transport roller (pre-alignment roller) 46, serving as a sheet rotating section. The third transport roller 46 transports a sheet P downstream, while rotating (turning) the sheet P.

On the upstream side of the third transport roller 46 is a fourth transport roller 47 that transports a sheet P toward the third transport roller 46.

The portion where the first transport roller 44 to the fourth transport roller 47 are provided has a function of transporting a sheet P, hence, this portion may be regarded as a sheet transport device.

In this exemplary embodiment, in addition to the aforementioned transport rollers, multiple transport rollers 48 are provided along the first sheet-transport path R1, the second sheet-transport path R2, and the third sheet-transport path R3 to transport a sheet P on these sheet-transport paths.

A fixing device 50 is provided on the second sheet-transport path R2. The fixing device 50 fixes an image second-transferred to a sheet P by the second transfer device 30.

Furthermore, between the second transfer device 30 and the fixing device 50 is a transport device 51, which transports a sheet P that has passed through the second transfer device 30 to the fixing device 50. The transport device 51 includes a revolving belt 51A that transports the sheet P thereon.

The fixing device 50 includes a heating roller 50A that is heated by a built-in heater (not shown) and a pressure roller 50B that presses the heating roller 50A.

In the fixing device 50, a sheet P is heated and pressed as it passes between the heating roller 50A and the pressure roller 50B. Thus, an image on the sheet P is fixed.

The image forming units 10 each include a rotatable photoconductor drum 11. The photoconductor drum 11 is surrounded by a charging device 12 that charges the photoconductor drum 11, an exposure device 13 that irradiates the photoconductor drum 11 with light to form an electrostatic latent image thereon, and a developing device 14 that develops the electrostatic latent image on the photoconductor drum 11 with toner.

In addition to the above, there are a first transfer device 15 that transfers the color-component toner image formed on the photoconductor drum 11 to the intermediate transfer belt 20, and a drum cleaning device 16 that removes residual toner on the photoconductor drum 11.

The intermediate transfer belt 20 is stretched around three rollers 21 to 23 so as to be able to revolve. Of these three rollers 21 to 23, the roller 22 drives the intermediate transfer belt 20. The roller 23 is opposed to the second transfer roller 31 with the intermediate transfer belt 20 therebetween, and the second transfer roller 31 and the roller 23 form the second transfer device 30. The roller 21 is opposed to a belt cleaning device 24 with the intermediate transfer belt 20 therebetween. The belt cleaning device 24 removes residual toner on the intermediate transfer belt 20.

The image forming apparatus 100 according to this exemplary embodiment is capable of forming an image not only on one side of a sheet P fed from the first sheet feed device 410, but also on the other side of the sheet P.

More specifically, in the image forming apparatus 100, a sheet P that has passed through the fixing device 50 is reversed by the reversing mechanism 500, and the reversed sheet P is transported back to the second transfer device 30, where an image is transferred to the other side of the sheet P. Then, the sheet P passes the fixing device 50 again, whereby the transferred image is fixed to the sheet P. In this way, images are formed on both sides of the sheet P.

In the reversing mechanism 500, first, a sheet P on the third sheet-transport path R3 is moved, for example, toward the front side of the image forming apparatus 100, which is a direction perpendicular to the direction along the third sheet-transport path R3. The sheet P is moved by a transport roller (not shown) provided for this purpose.

At this time, the transport rollers 48 on the third sheet-transport path R3 (the transport rollers 48 provided in the reversing mechanism 500) are separated.

The sheet P moved as above is directed upward by being guided by a guide member (not shown) having, for example, a substantially C-shaped section. The sheet P is transported further upward by transport rollers (not shown) for transporting the sheet P upward.

Then, the sheet P moves onto the first sheet-transport path R1 from a side of the first sheet-transport path R1. At this time, the transport rollers 48 on the first sheet-transport path R1 (the transport rollers 48 provided in the reversing mechanism 500) are separated.

Then, the sheet P is nipped by the transport rollers 48, and the transport rollers 48 are rotated. As a result, the reversed sheet P is directed to the second transfer device 30.

Figure 2:
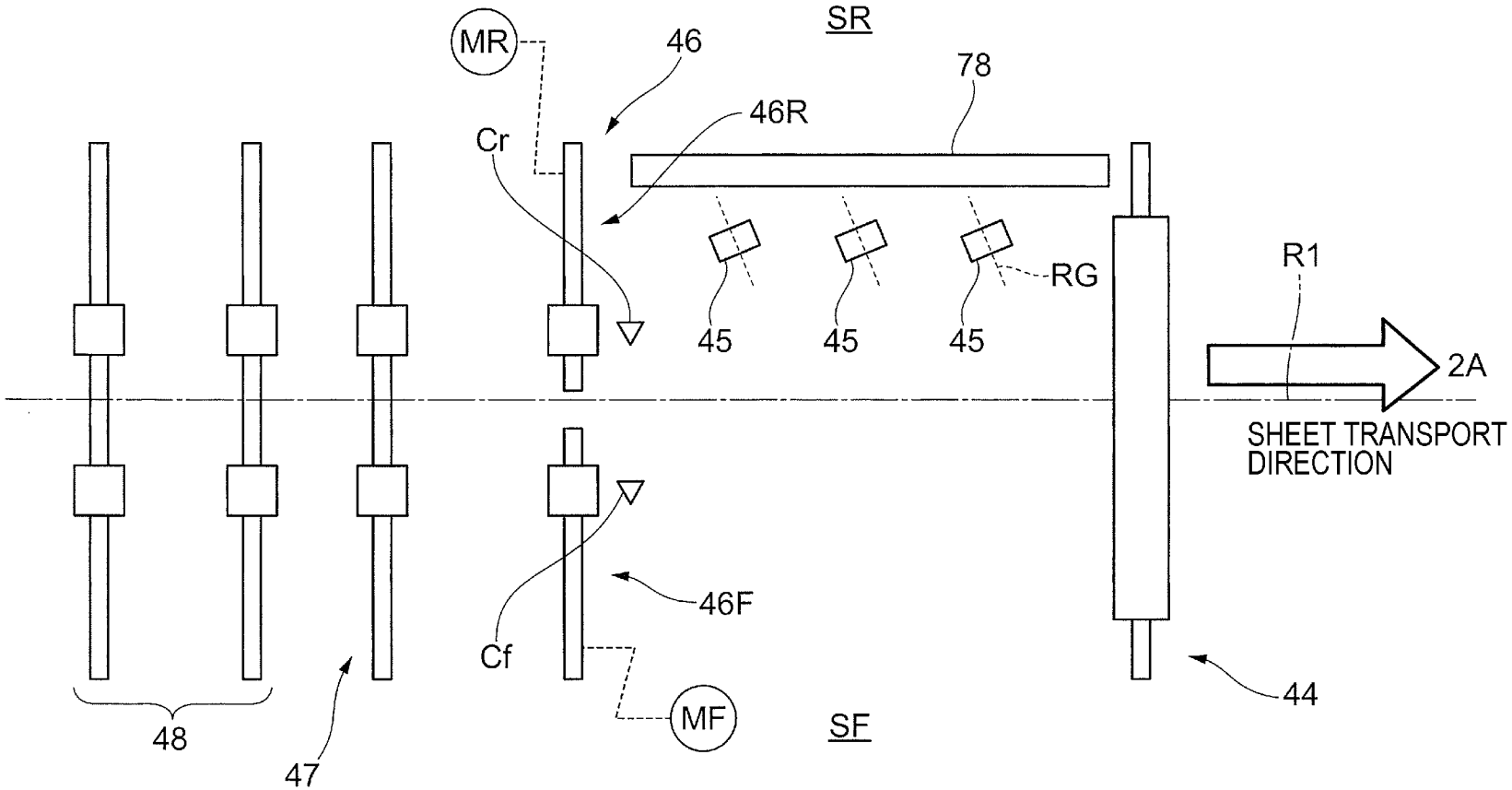
FIG. 2 shows a first sheet-transport path, as viewed from an arrow II direction in FIG. 1.

FIG. 2 shows the first sheet-transport path R1, as viewed from an arrow II direction in FIG. 1.

As shown in FIG. 2, and as has been described above, in this exemplary embodiment, the first transport roller (registration roller) 44 is provided on the first sheet-transport path R1.

The first transport roller 44 transports a sheet P on the first sheet-transport path R1 toward the second transfer device 30 (see FIG. 1).

The butting portion 78, against which a side edge of a sheet P on the first sheet-transport path R1 is butted, is provided at one side SR (i.e., a side on the rear side) of the first sheet-transport path R1.

The butting portion 78 has a plate shape and is provided along the first sheet-transport path R1.

The butting portion 78 is opposed to the second transport rollers (alignment rollers) 45. The second transport rollers 45 transport a sheet P downstream, while transporting the sheet P toward the butting portion 78 to make the side edge of the sheet P butt against the butting portion 78. There are multiple (in this exemplary embodiment, three) second transport rollers 45.

The second transport rollers 45 are provided obliquely. More specifically, the rotation shafts RG of the second transport rollers 45 are arranged at an angle to a direction perpendicular to the direction along the first sheet-transport path R1.

The third transport roller (pre-alignment roller) 46 includes a front-side roller 46F and a rear-side roller 46R.

The front-side roller 46F and the rear-side roller 46R are arranged such that they are shifted from each other in a direction perpendicular to (intersecting) the one direction (the direction indicated by an arrow 2A in FIG. 2), along which the sheet P is transported.

Furthermore, in this exemplary embodiment, a front-side motor MF that drives the front-side roller 46F, and a rear-side motor MR that drives the rear-side roller 46R are provided.

Hence, in this exemplary embodiment, the front-side roller 46F and the rear-side roller 46R are driven independently.

Furthermore, in this exemplary embodiment, two sensors, Cr and Cf, for detecting the leading end (leading edge) of a transported sheet P are provided between the third transport roller 46 and the second transport rollers 45. The sensor Cr is provided on the rear side, and the sensor Cf is provided on the front side.

Hereinbelow, the sensor Cr will be called a "rear sensor Cr", and the sensor Cf will be called a "front sensor Cf".

Figure 3:
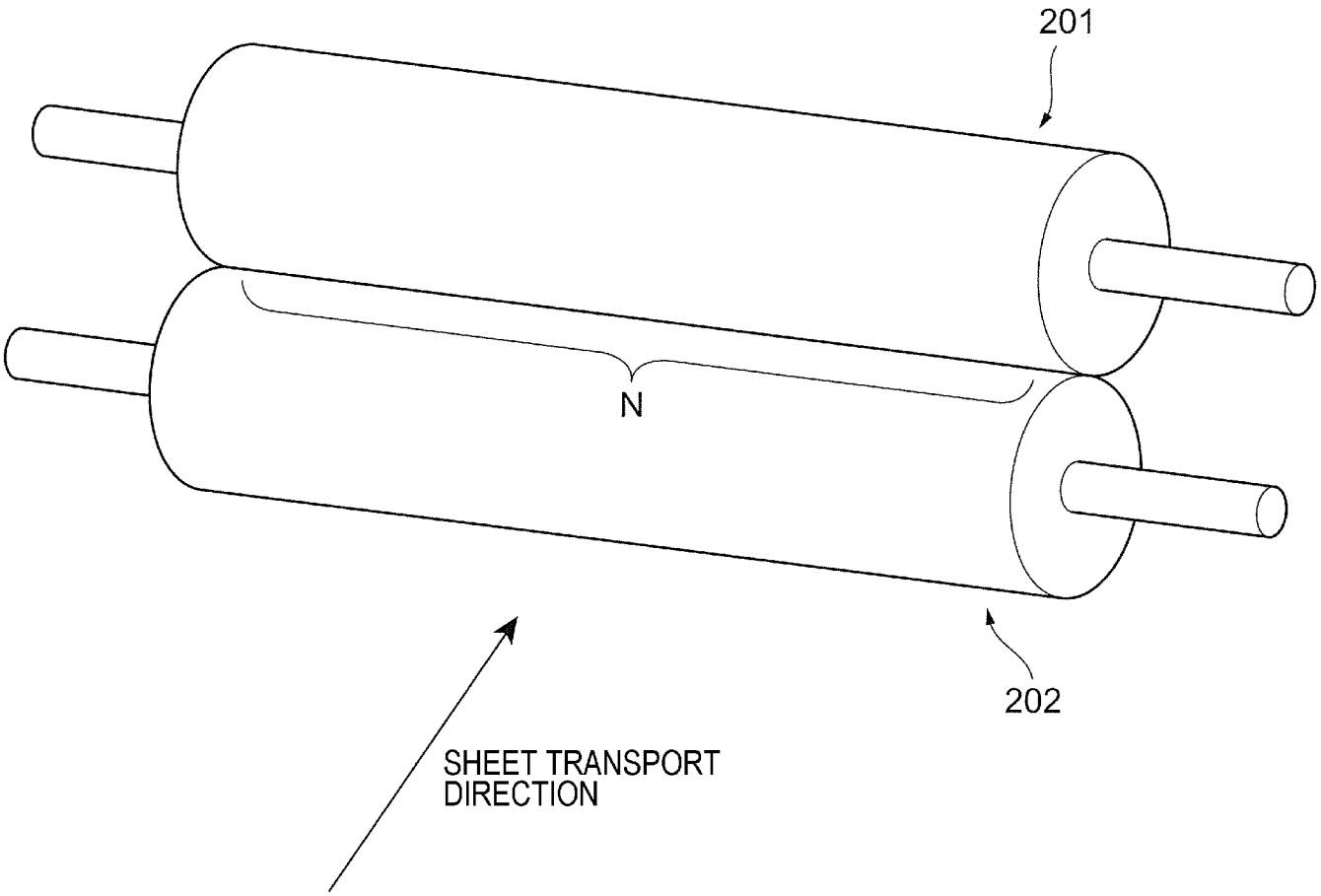
FIG. 3 shows transport rollers.

Note that the first transport roller 44, the second transport rollers 45, the front-side roller 46F, the rear-side roller 46R, the fourth transport roller 47, and the transport rollers 48 each include a pair of rotation members 201 and 202, as shown in FIG. 3.

The rotation member 201 drives the rotation member 202.

A nip part N, which comes into contact with a sheet P and applies a transport force to the sheet P, is formed at a contact portion between the rotation member 201 and the rotation member 202. The nip part N extends in a direction perpendicular to the transport direction of the sheet P.

Figure 4:
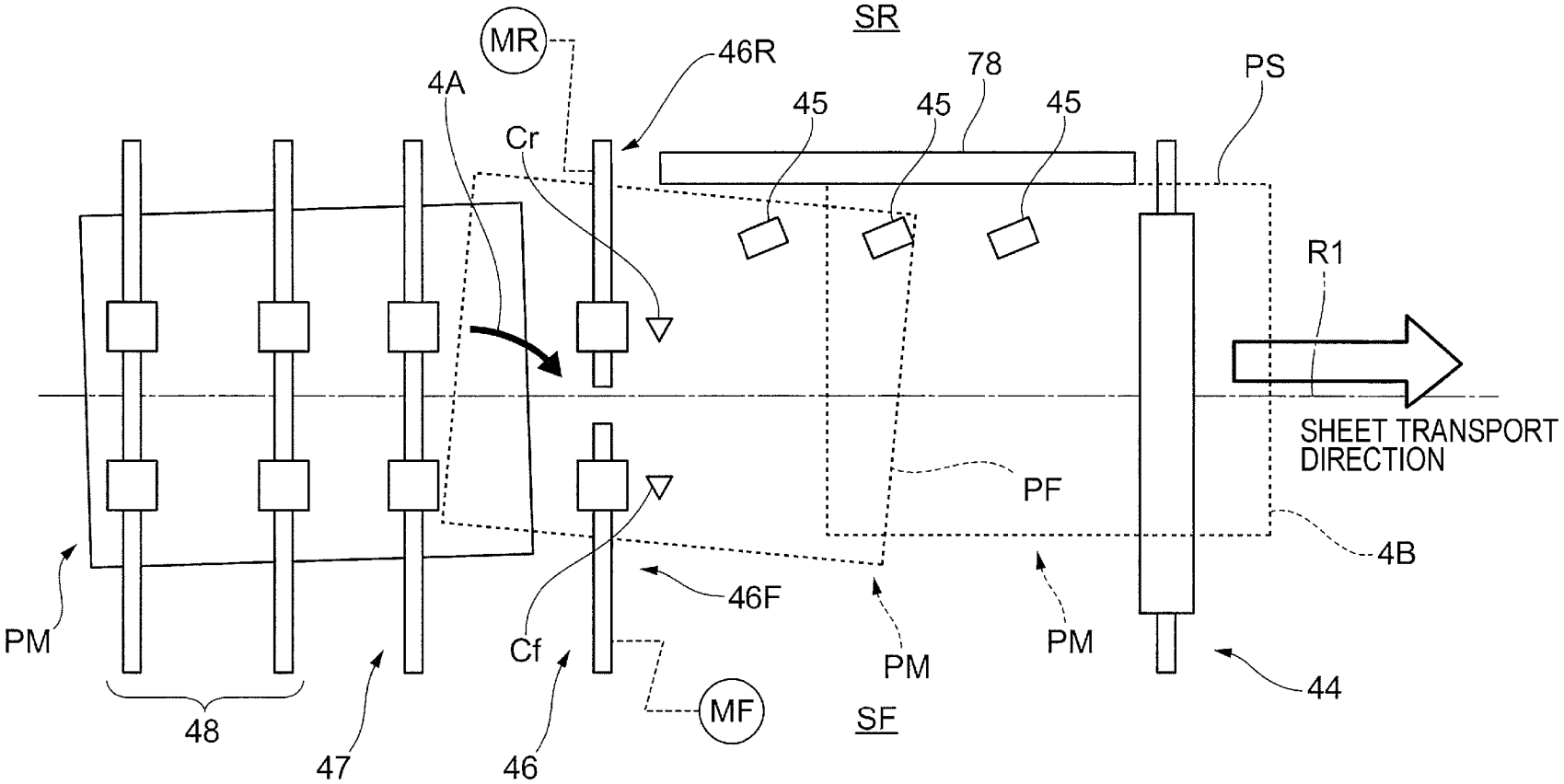
FIG. 4 shows the movement of a sheet on the first sheet-transport path.

FIG. 4 shows the movement of a sheet P on the first sheet-transport path R1.

More specifically, FIG. 4 shows the movement of a sheet P having a smaller sheet length than a predetermined sheet length, when transported.

Hereinbelow, a sheet P having a smaller sheet length than a predetermined sheet length is referred to as a "short sheet PM", and a sheet P having a larger sheet length than the predetermined sheet length is referred to as a "long sheet PL". The "sheet length" as used herein is the length of a sheet P in the sheet transport direction. More specifically, the sheet length is the length of a sheet P in the direction along the first sheet-transport path R1.

Information about the length of a sheet P (i.e., information used to determine whether the sheet P is a short sheet PM or a long sheet PL) may be obtained based on information input by a user via the UI 90. Alternatively, information about the length of a sheet P may be obtained based on output from a sensor for detecting the sheet length, which is provided on the first sheet feed device 410 (see FIG. 1) or the second sheet feed device 420.

When a short sheet PM is transported from the upstream side and reaches the third transport roller 46, serving as a part of the sheet rotating section, the short sheet PM is rotated. More specifically, as shown by an arrow 4A, the short sheet PM is rotated such that a leading end PF of the short sheet PM is directed to the other side, SF, of the first sheet-transport path R1.

While the short sheet PM is transported, the rotation speed Vr of the rear-side roller 46R is higher than the rotation speed Vf of the front-side roller 46F, whereby the short sheet PM is rotated.

Next, in this exemplary embodiment, the second transport rollers 45 move the short sheet PM toward the butting portion 78, making the short sheet PM straight, as indicated by reference numeral 4B.

In other words, the short sheet PM is parallel to the direction along the first sheet-transport path R1 without skew. Hence, in this exemplary embodiment, a problem that an image formed on a short sheet PM is oblique relative to the side edge PS, is less likely to occur.

In this exemplary embodiment, once a short sheet PM reaches the second transport rollers 45, and the second transport rollers 45 start to transport the short sheet PM, the rotation members 201 and 202 (see FIG. 3) of the front-side roller 46F and rear-side roller 46R are separated from each other.

This makes the short sheet PM easy to move, and the short sheet PM moves more smoothly toward the butting portion 78. The rotation members 201 and 202 are separated by an existing mechanism, such as a cam and a motor.

In this exemplary embodiment, in order to rotate the short sheet PM such that the leading end PF is directed to the other side SF, when the short sheet PM is butted against the butting portion 78, the trailing end of the short sheet PM is butted against the butting portion 78 prior to the leading end.

In this way, in this exemplary embodiment, when the short sheet PM starts to be butted against the butting portion 78, the short sheet PM is displaced such that the side edge PS of the short sheet PM gradually becomes parallel to the butting portion 78. By displacing the short sheet PM in this manner, damage to the short sheet PM is reduced.

More specifically, in the case where the trailing end of the short sheet PM is butted against the butting portion 78 prior to the leading end, as in this exemplary embodiment, damage to the leading end PF of the short sheet PM is less likely to occur, compared with a case where the leading end is butted against the butting portion 78 prior to the trailing end.

Figure 5:
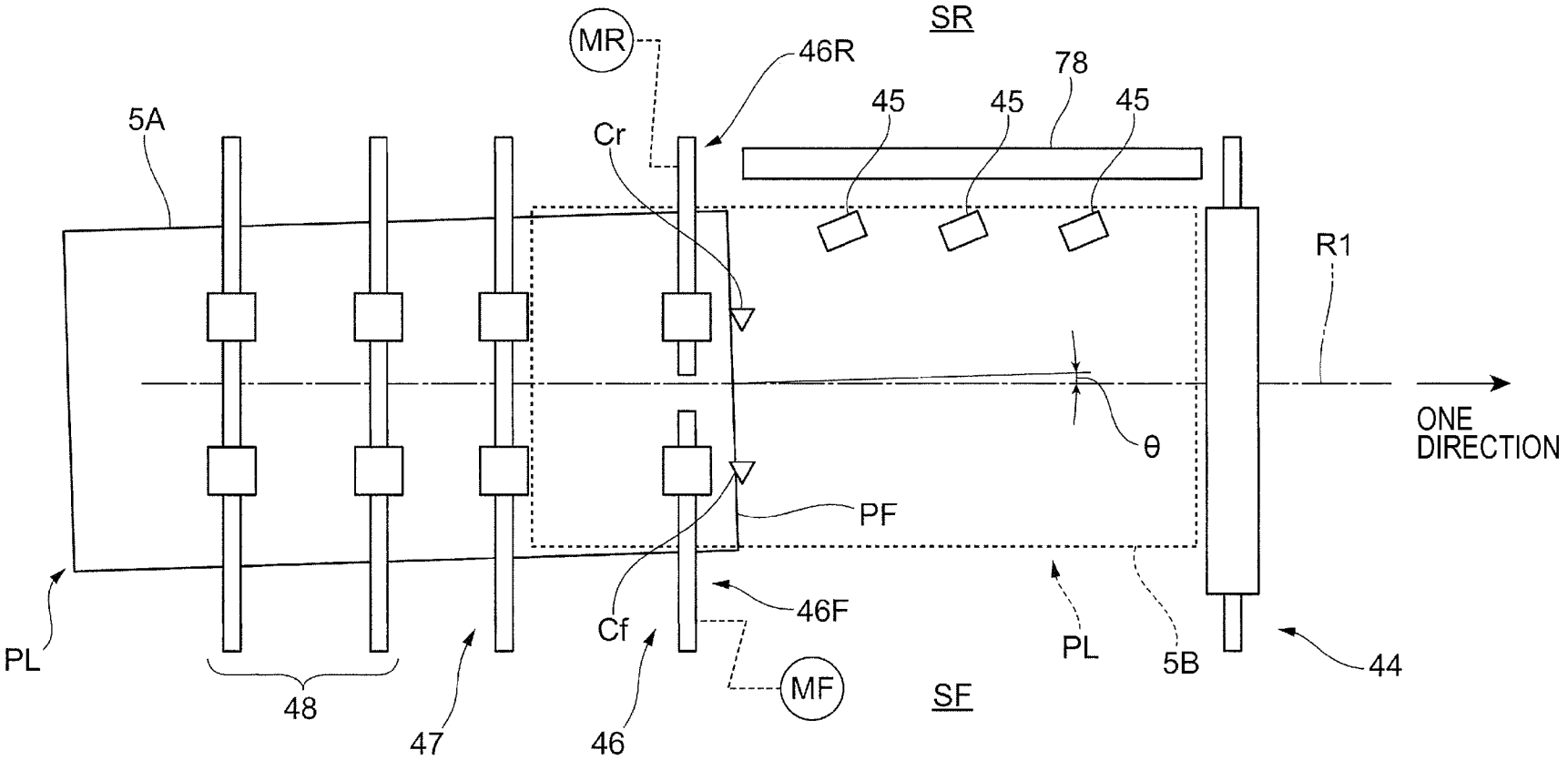
FIG. 5 shows the movement of a long sheet on the first sheet-transport path.

FIG. 5 shows the movement of a long sheet PL on the first sheet-transport path R1.

When a long sheet PL is transported, first, the rotation speed Vr of the rear-side roller 46R and the rotation speed Vf of the front-side roller 46F are set equal. More specifically, the diving frequency of the front-side motor MF and the diving frequency of the rear-side motor MR are set equal.

When a long sheet PL is transported, the rotation members 201 and 202 of the second transport rollers 45 are separated. Similarly to the above, the rotation members 201 and 202 are separated by an existing mechanism, such as a cam and a motor.

When a long sheet PL is transported as indicated by reference numeral 5A in FIG. 5, the leading end PF of the long sheet PL is detected by the rear sensor Cr and the front sensor Cf. Based on the detection results, the amount of skew (amount of inclination) of the long sheet PL is obtained.

If the amount of skew is large, the time lag between when the rear sensor Cr detects the leading end PF of the long sheet PL and when the front sensor Cf detects the leading end PF of the long sheet PL is large, and if the amount of skew is small, this time lag is small.

Then, based on the amount of skew obtained, the rear-side roller 46R and the front-side roller 46F are controlled such that the skew of the long sheet PL is reduced.

More specifically, the rear-side roller 46R and the front-side roller 46F are controlled such that the angle of inclination, θ, of the long sheet PL with respect to the direction along the first sheet-transport path R1 is reduced. In the example shown in FIG. 5, the rotation speed Vf of the front-side roller 46F is set lower than the rotation speed Vr of the rear-side roller 46R to reduce the angle of inclination θ of the long sheet PL.

In this way, in this exemplary embodiment, as indicated by reference numeral 5B, the long sheet PL becomes parallel to the first sheet-transport path R1.

As described above, in this exemplary embodiment, when the long sheet PL is transported, the rotation members 201 and 202 of the second transport rollers 45 are separated.

Hence, in this exemplary embodiment, the long sheet PL passes through the second transport rollers 45 without moving toward the butting portion 78.

Figure 6:
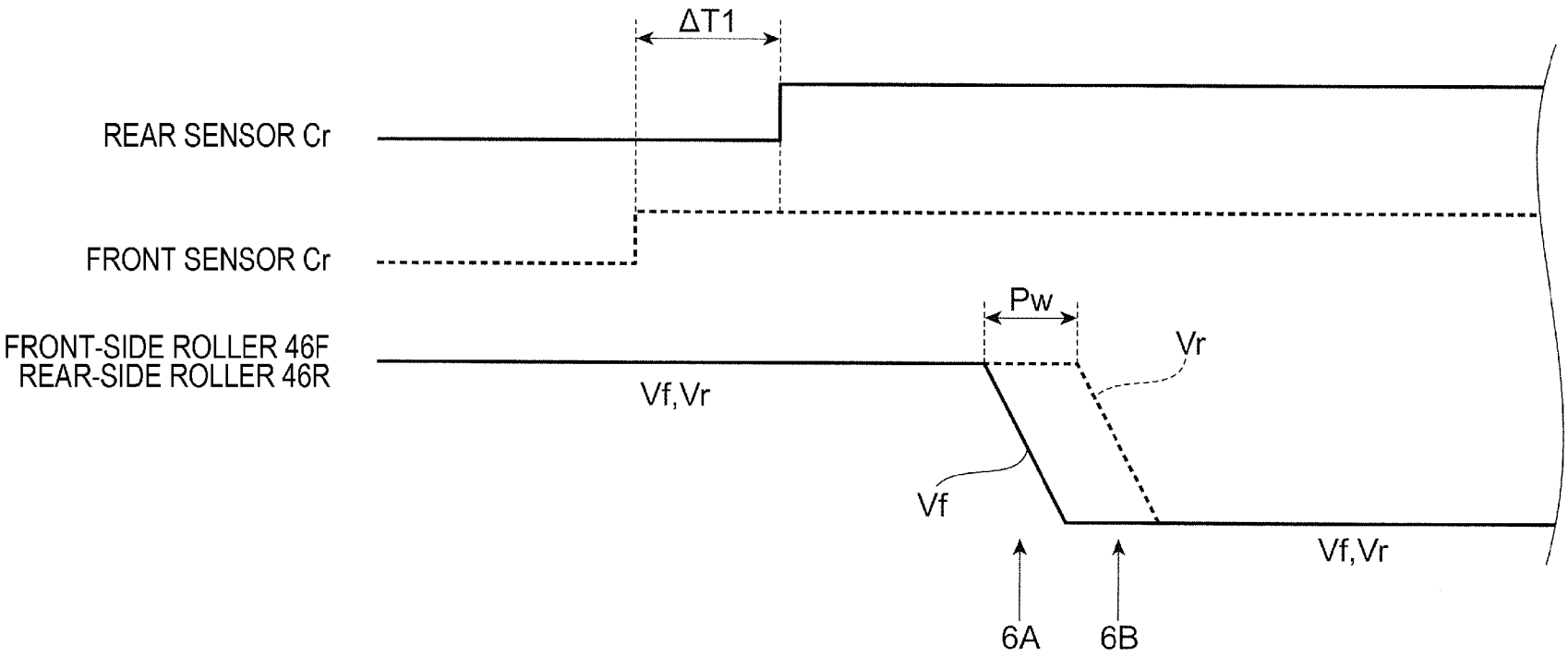
FIG. 6 is a timing chart when a long sheet is transported.

FIG. 6 is a timing chart when a long sheet PL is transported.

As described above, in this exemplary embodiment, when a long sheet PL is transported, the rear sensor Cr and the front sensor Cf detect the leading end PF of the long sheet PL. Based on the detection results, the amount of skew (amount of inclination) of the sheet P is obtained.

FIG. 6 shows an example case where the leading end PF is detected first by the front sensor Cf and then by the rear sensor Cr.

In this example, the time lag between when the front sensor Cf detects the leading end PF and when the rear sensor Cr detects the leading end PF is a time lag ΔT1.

After the rear sensor Cr and the front sensor Cf detect the leading end PF, in this exemplary embodiment, the rotation speed Vr of the rear-side roller 46R and the rotation speed Vf of the front-side roller 46F are differentiated to rotate (correct skew of) the long sheet PL.

More specifically, as indicated by reference numeral 6A in FIG. 6, the rotation speed Vf of the front-side roller 46F is set lower than the rotation speed Vr of the rear-side roller 46R. By doing so, the long sheet PL rotates, reducing the amount of skew.

Then, in this exemplary embodiment, as indicated by reference numeral 6B, the rotation speed Vr of the rear-side roller 46R is reduced to make the rotation speed Vf of the front-side roller 46F and the rotation speed Vr of the rear-side roller 46R equal. Then, the long sheet PL is further transported downstream.

In this example, the rotation speed Vf of the front-side roller 46F is reduced first.

Then, after a predetermined number of pulses Pw (see FIG. 6) has been counted, the rotation speed Vr of the rear-side roller 46R is reduced. More specifically, after the rear-side motor MR is rotated by the number of pulses Pw from the point where the rotation speed Vf of the front-side roller 46F starts to be reduced, the rotation speed Vr of the rear-side roller 46R is reduced.

The number of pulses Pw is obtained by:

$$Pw\ (\text{number of pulses})=(\Delta T1*Vf(Vf-Vr))/Tp \qquad \text{(Expression 1)}$$

where ΔT1 is the time lag between when the front sensor Cf detects the leading end PF and when the rear sensor Cr detects the leading end PF, Tp is the time per pulse of the front-side motor MF and the rear-side motor MR, Vf is the rotation speed of the front-side roller 46F, and Vr is the rotation speed of the rear-side roller 46R.

Although FIG. 6 shows an example case where the leading end PF is detected first by the front sensor Cf and then by the rear sensor Cr, if the leading end PF is detected first by the rear sensor Cr and then by the front sensor Cf, the rotation speed Vr of the rear-side roller 46R is reduced first, and then the rotation speed Vf of the front-side roller 46F is reduced.

As has been described above, in this exemplary embodiment, the position of a short sheet PM is corrected by making the side edge PS butt against the butting portion 78. However, a long sheet PL is not butted against the butting portion 78.

In this exemplary embodiment, because a long sheet PL has a large sheet length, the trailing end of the long sheet PL may be nipped by the fourth transport roller 47 or the like when the long sheet PL has reached the second transport rollers 45. Furthermore, in this exemplary embodiment, because part of the first sheet-transport path R1 is curved, as indicated by reference numeral 1A in FIG. 1, the trailing end of the long sheet PL may be located at this curved portion of the first sheet-transport path R1.

In such cases, it is impossible to move the long sheet PL with the second transport rollers 45, failing to make the long sheet PL butt against the butting portion 78.

Hence, in this exemplary embodiment, the long sheet PL is rotated by the transport roller 46, without being butted against the butting portion 78. In this way, skew correction of a long sheet PL is performed.

In addition to the rotation (skew correction) by the transport roller 46, the long sheet PL may be butted against the first transport roller 44 that stops rotating.

Figure 7:
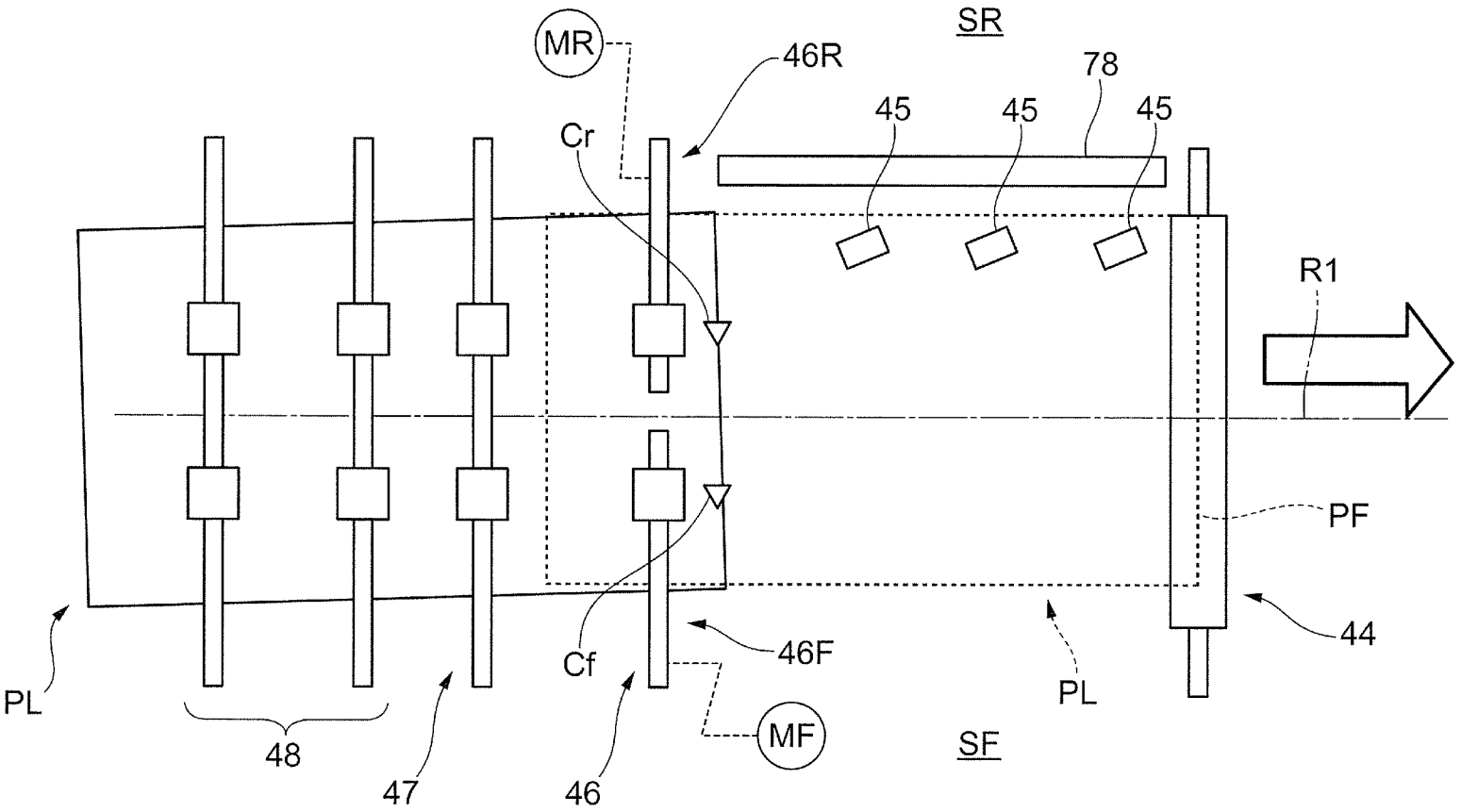
FIG. 7 shows another skew correction example of a long sheet.

More specifically, as shown in FIG. 7, a long sheet PL is transported from the upstream side toward the first transport roller 44 that stops rotating by the third transport roller 46, which also serves as the transport section.

When the long sheet PL reaches the first transport roller 44, the leading end PF of the long sheet PL is butted against the first transport roller 44. More specifically, the leading end PF of the long sheet PL is butted against the nip part N shown in FIG. 3.

The nip part N extends in a direction perpendicular to the direction along the first sheet-transport path R1. When the leading end PF of the long sheet PL is butted against the nip part N, the leading end PF of the long sheet PL becomes parallel to the direction perpendicular to the direction along the first sheet-transport path R1. Thereafter, in this exemplary embodiment, the first transport roller 44 starts to transport the long sheet PL. The amount of skew of the long sheet PL transported by the first transport roller 44 is small.

When a long sheet PL is butted against the first transport roller 44, the long sheet PL is kept transported toward the first transport roller 44 by a predetermined amount after the leading end PF of the long sheet PL is butted against the first transport roller 44. As a result, the long sheet PL forms a loop.

The amount of transportation of the long sheet PL after the leading end PF is butted against the first transport roller 44 may be changed according to the basis weight of the long sheet PL.

More specifically, when the basis weight of a long sheet PL is larger than a predetermined basis weight, the amount of transportation is increased compared with a case where the basis weight of the long sheet PL is smaller than the predetermined basis weight.

A long sheet PL having large basis weight has high stiffness, and the leading end PF of the long sheet PL does not easily become parallel to the first transport roller 44. Hence, by increasing the amount of transportation, the leading end PF of the long sheet PL easily becomes parallel to the first transport roller 44. Information about the basis weight may be obtained from, for example, the information about the sheet P input by a user via the UI 90.

Figure 8:
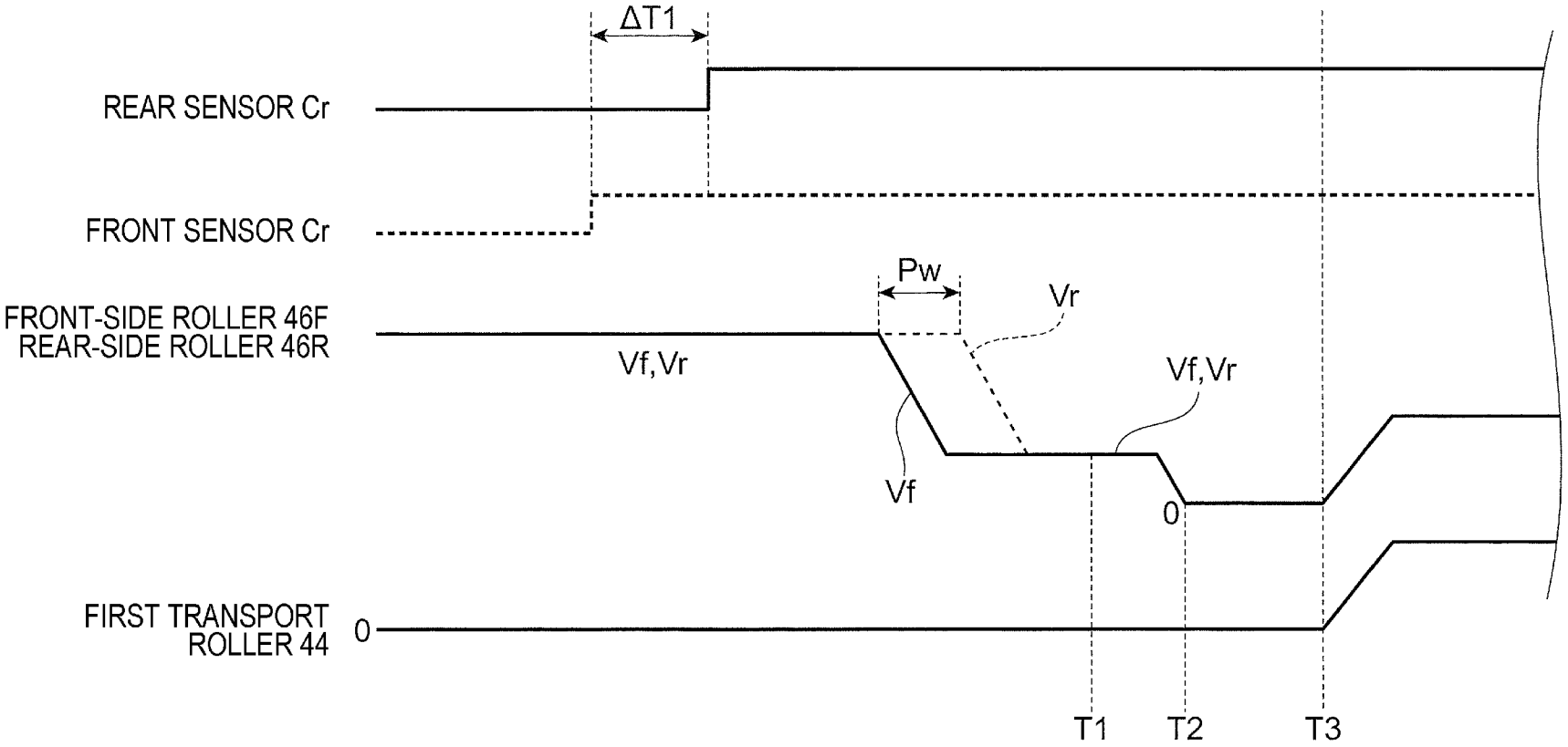
FIG. 8 is a timing chart when a leading end of a long sheet is butted against first transport rollers.

FIG. 8 is a timing chart when the leading end PF of a long sheet PL is butted against the first transport roller 44. In FIG. 8, the processing before time T1 is the same as above, hence, the processing after time T1 will be described.

In this processing, the front-side motor MF and the rear-side motor MR are stopped at time T2. As a result, the rotation speed Vr of the rear-side roller 46R and the rotation speed Vf of the front-side roller 46F become zero.

At this time, the first transport roller 44 is stopped. The leading end PF of the long sheet PL is butted against the first transport roller 44, and the long sheet PL forms a loop.

Then, in this exemplary embodiment, the first transport roller 44 starts to be rotated at time T3. As a result, the long sheet PL is sent to the second transfer device 30 (see FIG. 1).

At this time, in this exemplary embodiment, the rear-side roller 46R and the front-side roller 46F start (restart) to be rotated.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

a transport path configured to transport a sheet in one direction;

a sheet butting portion provided at one side of the transport path, wherein the sheet butting portion is configured to butt against a side edge of the sheet on the transport path;

a sheet rotating section;

a sheet butting section disposed on a downstream side of the sheet rotating section, wherein the sheet butting section is separable; and a sheet transport member configured to transport the sheet downstream, wherein the sheet transport member is provided on a downstream side of the sheet butting section, wherein the sheet butting section is configured to contact and transport a long sheet from an upstream side toward the sheet transport member when the sheet transport member is stopped, wherein the sheet transport device further comprises a receiver configured to receive information about the sheet, the information including a sheet length and a basis weight, wherein the sheet rotating section is configured to, when a short sheet, which has a shorter sheet length than a predetermined sheet length, is transported along the transport path, rotate the short sheet such that a leading end thereof is directed to an other side of the transport path, wherein the sheet rotating section is configured to, when a long sheet, which has a longer sheet length than the predetermined sheet length, is transported, rotate the long sheet such that an angle of inclination with respect to the one direction is reduced, wherein the sheet butting section is configured to move the short sheet rotated by the sheet rotating section toward the one side of the transport path to make the side edge of the short sheet butt against the sheet butting portion, while wherein the sheet butting section is configured to separate to allow the long sheet to pass therethrough without moving the long sheet toward the one side, wherein the sheet transport member is configured to be stopped when the long sheet has reached the sheet transport member via the sheet butting section, and the leading end of the long sheet is butted against the stopped sheet transport member, wherein the sheet transport member is configured to transport the long sheet after the leading end of the long sheet is butted against the sheet transport member, and wherein the sheet transport member is configured to change an amount of transportation of the long sheet that occurs after the leading end is butted against the sheet transport member according to a basis weight of the long sheet, such that the amount of transportation is larger for a long sheet having a greater basis weight than a predetermined basis weight than for a long sheet having a smaller basis weight than the predetermined basis weight.

2. A sheet transport device comprising:

a transport path configured to transport a sheet in one direction;

a sheet butting portion provided at one side of the transport path, wherein the sheet butting portion is configured to butt against a side edge of the sheet on the transport path;

a sheet rotating section;

a sheet butting section disposed on a downstream side of the sheet rotating section; and a sheet transport member, wherein the sheet butting section is configured to contact and transport a long sheet from an upstream side toward the sheet transport member when the sheet transport member is stopped, wherein the sheet transport member is configured to transport the sheet downstream, wherein the sheet transport member is provided on a downstream side of the sheet butting section, wherein the sheet transport device further comprises a receiver configured to receive information about the sheet, the information including a sheet length and a basis weight, wherein the sheet rotating section is configured to, when a short sheet, which has a shorter sheet length than a predetermined sheet length, is transported along the transport path, rotate the short sheet such that a leading end thereof is directed to an other side of the transport path, wherein the sheet rotating section is configured to, when a long sheet, which has a longer sheet length than the predetermined sheet length, is transported, rotate the long sheet such that an angle of inclination with respect to the one direction is reduced, wherein the sheet butting section is configured to move the short sheet rotated by the sheet rotating section toward the one side of the transport path to make the side edge of the short sheet butt against the sheet butting portion, while wherein the sheet butting section is configured to separate to allow the long sheet to pass therethrough without moving the long sheet toward the one side, wherein the sheet butting section is configured to move the short sheet toward the one side with a rotation member pair, which includes two separable rotation members that are in contact with each other, wherein the sheet transport member is configured to transport the long sheet after the leading end of the long sheet is butted against the sheet transport member, wherein the sheet transport member is configured to change an amount of transportation of the long sheet that occurs after the leading end is butted against the sheet transport member according to a basis weight of the long sheet, such that the amount of transportation is larger for a long sheet having a greater basis weight than a predetermined basis weight than for a long sheet having a smaller basis weight than the predetermined basis weight, and wherein the sheet transport member is configured to be stopped when the long sheet has reached the sheet transport member via the sheet butting section, and the leading end of the long sheet is butted against the stopped sheet transport member.

* * * * *